US006658793B2

(12) United States Patent
Perron

(10) Patent No.: US 6,658,793 B2
(45) Date of Patent: Dec. 9, 2003

(54) EXTERNAL WINDOW SHUTTER

(76) Inventor: Jocelyn Perron, 895, ave Joffre, Quebec QBC (CA), G1S 3L9

( * ) Notice: Subject to any disclaimer, the term of this patent is extended or adjusted under 35 U.S.C. 154(b) by 0 days.

(21) Appl. No.: 10/310,893

(22) Filed: Dec. 6, 2002

(65) Prior Publication Data

US 2003/0110697 A1 Jun. 19, 2003

Related U.S. Application Data

(63) Continuation-in-part of application No. 10/020,246, filed on Dec. 18, 2001, now abandoned.

(51) Int. Cl.[7] ..... E05C 7/06
(52) U.S. Cl. ..... 49/123; 49/63; 49/360
(58) Field of Search ..... 49/116, 123, 61, 49/63, 324, 354, 360

(56) References Cited

U.S. PATENT DOCUMENTS

| | | | |
|---|---|---|---|
| 802,167 | A | 10/1905 | Hutt |
| 1,161,331 | A | 11/1915 | Phillips |
| 1,801,115 | A | 4/1931 | Semish |
| 2,301,568 | A | 11/1942 | Moss |
| 2,611,936 | A | 9/1952 | Wheeler |
| 2,808,626 | A | 10/1957 | Sassano |
| 3,452,477 | A | 7/1969 | Sassano |
| 3,494,073 | A | 2/1970 | Meddick |
| 4,242,836 | A | 1/1981 | Anderson |
| 4,267,666 | A | 5/1981 | Davidson |
| 4,457,106 | A | 7/1984 | Forquer |
| 4,674,231 | A | 6/1987 | Radek et al. |
| 5,893,242 | A | 4/1999 | Perron |
| 6,021,605 | A | 2/2000 | Laux et al. |

FOREIGN PATENT DOCUMENTS

| | | |
|---|---|---|
| CH | 39994 | 6/1907 |

*Primary Examiner*—Jerry Redman

(57) ABSTRACT

An external window shutter for use in front of an exterior window opening includes a frame surrounding the window opening and is attached to an exterior wall surface. The shutter has two panels that are movably mounted on the frame. The panels are mounted generally parallel to the wall surface and to the frame, and are actuatable along a path of travel between an open configuration and a closed configuration. The shutter includes a first guide member attached to respective upper and lower portions of a window facing surface of each panel and extending substantially along the entire length of each panel; and a second guide member attached to respective upper and lower portions of an outwardly disposed surface of the frame and extending substantially along the entire length of the upper and lower portions of said outwardly disposed surface of the frame. The guide members each have complementary engager parts shaped to slidably engage each other for moving the panels along the path of travel, the engager parts being located on the same side of the frame. The panels, when positioned together in the closed configuration, substantially enclose the frame.

16 Claims, 7 Drawing Sheets

EXTERNAL WINDOW SHUTTER

CROSS-REFERENCE TO RELATED APPLICATION

The present application is a Continuation-In-Part (C.I.P.) application of patent application Ser. No. 10/020,246 filed on Dec. 18, 2001, now abandoned.

FIELD OF THE INVENTION

The present invention relates to an external window shutter, and more particularly to a shutter having a driving mechanism allowing for simultaneous displacement, in opposite direction, of both panels of the window shutter.

BACKGROUND OF THE INVENTION

Window shutter units to hide and unhide a window opening by simultaneously displacement of flat panels have been known a long time.

U.S. Pat. No. 2,301,568 issued to F. J. Moss on Nov. 10, 1942, disclose shutter panels moving along tracks between an opened position at the side of a window and a closed position in front of the window and that are manipulated by means of cables extending through the building wall to be accessible inside the building. The panels of the window shutter are not designed for tight mutual engagement in the closed position.

U.S. Pat. No. 4,267,666 issued to James D. Davidson on May 19, 1981 describes a shutter system which cannot be activated by users from inside the building.

U.S. Pat. No. 5,893,242 issued to Perron on Apr. 13, 1999 describes thermally insulating external window shutter, in which only one panel of the shutter is activated at a time, thus requiring one bore through the wall of the house for driving each panel of the shutter.

U.S. Pat. No. 3,494,073 issued to Meddick on Feb. 10, 1970 discloses a frame having front and rear channels on which window shutters move. Also disclosed are two separate off-frame guides on which the shutters move once they have cleared the window opening. When the shutters are in their closed configuration, the off-frame guides will be exposed on the wall. This increases the overall size of the frame and is aesthetically disfavoured. In addition, since both the off-frame guides and the channels are exposed during opening and closing, particulate matter such as snow, ice or dirt may interfere with the operation of the shutters.

OBJECTS OF THE INVENTION

It is therefore a general object of the present invention to provide an external window shutter that obviates the above mentioned disadvantages.

An advantage of the present invention is that the external window shutter secures the panels of the shutter against each other for efficient hiding of the window opening with the shutter in closed configuration.

A further advantage of the present invention is that the external window shutter has a driving mechanism easily activated from inside the building and simultaneously driving both panels.

Still a further advantage of the present invention is that the external window shutter is easily and entirely assembled (or preassembled) on a frame that mounts on the external wall in front of a window opening.

Still another advantage of the present invention is that the external window shutter is a self-contained, unitary construction that requires only minimal adaptation of the wall during installation.

Still another advantage of the present invention is that the external window shutter can be custom made to fit windows of any dimension, thereby reducing the need for adjustments after installation.

A further advantage of the present invention is that the external window shutter has a novel guide system, mounted on opposing frame and panel surfaces, which is protected from the elements such that interference by particulate matter such as snow, ice or dirt is substantially reduced or essentially eliminated.

Another advantage of the present invention is that the external window shutter includes a closed frame without any outwardly extending frame pieces, thereby increasing the aesthetic appearance of the window shutter, especially when closed.

Another advantage of the present invention is that the external window shutter, which is installed with minimum bore through the wall.

Still another advantage of the present invention is that the external window shutter includes a retaining mechanism that constantly retains the panels in a vertically oriented position, especially when in the opened configuration.

Other objects and advantages of the present invention will become apparent from a careful reading of the detailed description provided herein, with appropriate reference to the accompanying drawings.

SUMMARY OF THE INVENTION

According to an aspect of the present invention, there is provided an external window shutter for disposing in front of an exterior window opening, the shutter having a frame surrounding the window opening and attached to an exterior wall surface, the shutter having two panels movably mounted on the frame, the panels being mounted generally parallel to the wall surface and to the frame, the panels being actuatable along a path of travel between an open configuration and a closed configuration, the shutter comprising: first guide member attached to respective upper and lower portions of a window facing surface of each panel and extending substantially along the entire length of each panel; second guide member attached to respective upper and lower portions of an outwardly disposed surface of the frame and extending substantially along the entire length of the upper and lower portions of the outwardly disposed surface of the frame; the first and second guide members each having complementary first and second engager parts shaped to slidably engage each other for moving the panels along the path of travel, said first and second guide members being located on the a same side of said frame; the panels, when positioned together in said closed configuration, substantially enclose the frame.

Typically, the window shutter further including a driving mechanism carried by the frame and connecting to the panels to simultaneously displace the panels in opposite directions along each of the guide members, either toward or away from each other into the closed or opened configuration of the shutter, respectively, the mechanism including: a transmission shaft extending through the wall, the shaft having first and second ends internally and externally protruding from the wall, respectively; a power device connected to the first end of the shaft to rotate the shaft; a first wheel connected to the second end of the shaft; a second wheel externally and rotatably mounted on the frame; and a transmission wire engaging the first and second wheels to rotatably connect the second wheel to the first wheel, the wire forming an elongated closed loop defining two substantially linear portions between the first and second wheels, each one of the panels connecting to a respective one of the linear portions of the wire.

Typically, the wire includes a tensioning means longitudinally integrated into at least one of the linear portions, thereby ensuring tension in the transmission wire.

Typically, the transmission wire is a belt meshing with the wheels. Typically, the wheels are cogwheels and the belt has corrugations meshing with the cogwheels.

Typically, the power device is made of a manually operable crank adjustably connected to the first end of the transmission shaft.

Typically, the driving mechanism includes a locking device preventing rotation of the transmission shaft, thereby blocking the transmission wire and the panels from moving relative to the frame.

Typically, the transmission shaft is longitudinally adjustable for fitting different thickness of walls.

Alternatively, the transmission shaft includes a universal joint connecting the first and second ends together, the universal joint being located internally the wall to allow the power device to move laterally relative to the wall.

In one embodiment, the shutter further includes a retaining mechanism for constantly retaining in a vertically oriented position a pair of opposed sliding panels of a window shutter installed in front of a window opening, the window shutter including a frame slidably carrying the opposed panels, the panels being generally planar and parallel to each other, the retaining mechanism comprises:

at least four coplanar supports positioned for enclosing the window opening, each of the supports mounting on the frame and including two coaxial pulleys independently freely rotating from each other and two cables meshing with a respective one of the two coaxial pulleys of each support to form first and second enclosures around the window opening, each of the enclosures being generally parallel to each other and defining upper and lower generally linear horizontal segments and two generally linear vertical side segments, one of the panels connecting to the upper and lower portions of the first and second enclosures, respectively, with the other one of the panels connecting to the upper and lower portions of the second and first enclosures, respectively.

Typically, at least one of the enclosures includes a second tensioning means longitudinally integrated into at least one of the segments, thereby ensuring tension in the cables.

Alternatively, the driving mechanism connects indirectly to the panels through the cables to simultaneously displace the panels in opposite directions along each of the guide members, either toward or away from each other into the closed or opened configuration of the shutter, respectively.

Typically, the driving mechanism includes:

a transmission shaft extending through the wall, the shaft having first and second ends internally and externally protruding from the wall, respectively;

a power device connected to the first end of the shaft to rotate the shaft;

a first wheel connected to the second end of the shaft;

a second wheel externally and rotatably mounted on the frame; and a transmission wire engaging the first and second wheels to rotatably connect the second wheel to the first wheel, the wire forming an elongated closed loop defining two substantially linear portions between the first and second wheels, each one of the linear portions of the wire connecting to one of the segments of a respective one of the cables.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will herein be described for indicative purposes and by no means as of limitation.

Figure 1:
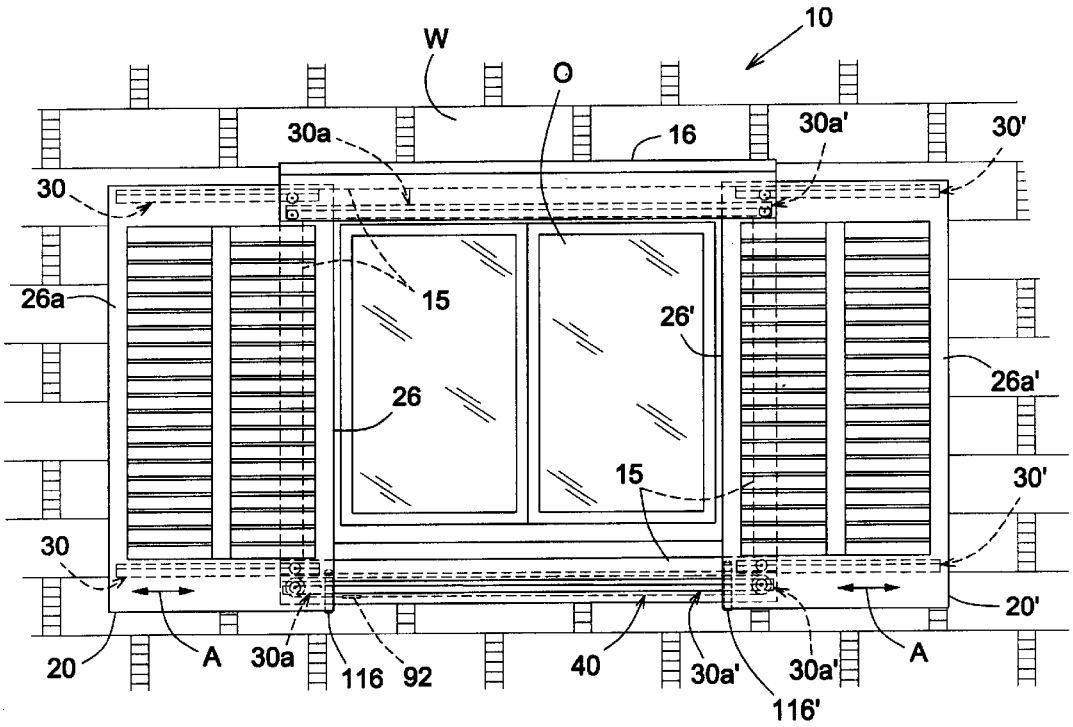
FIG. 1 is a front elevation view of an external window shutter of the invention in opened configuration being install in front of a window opening.
Figure 3:
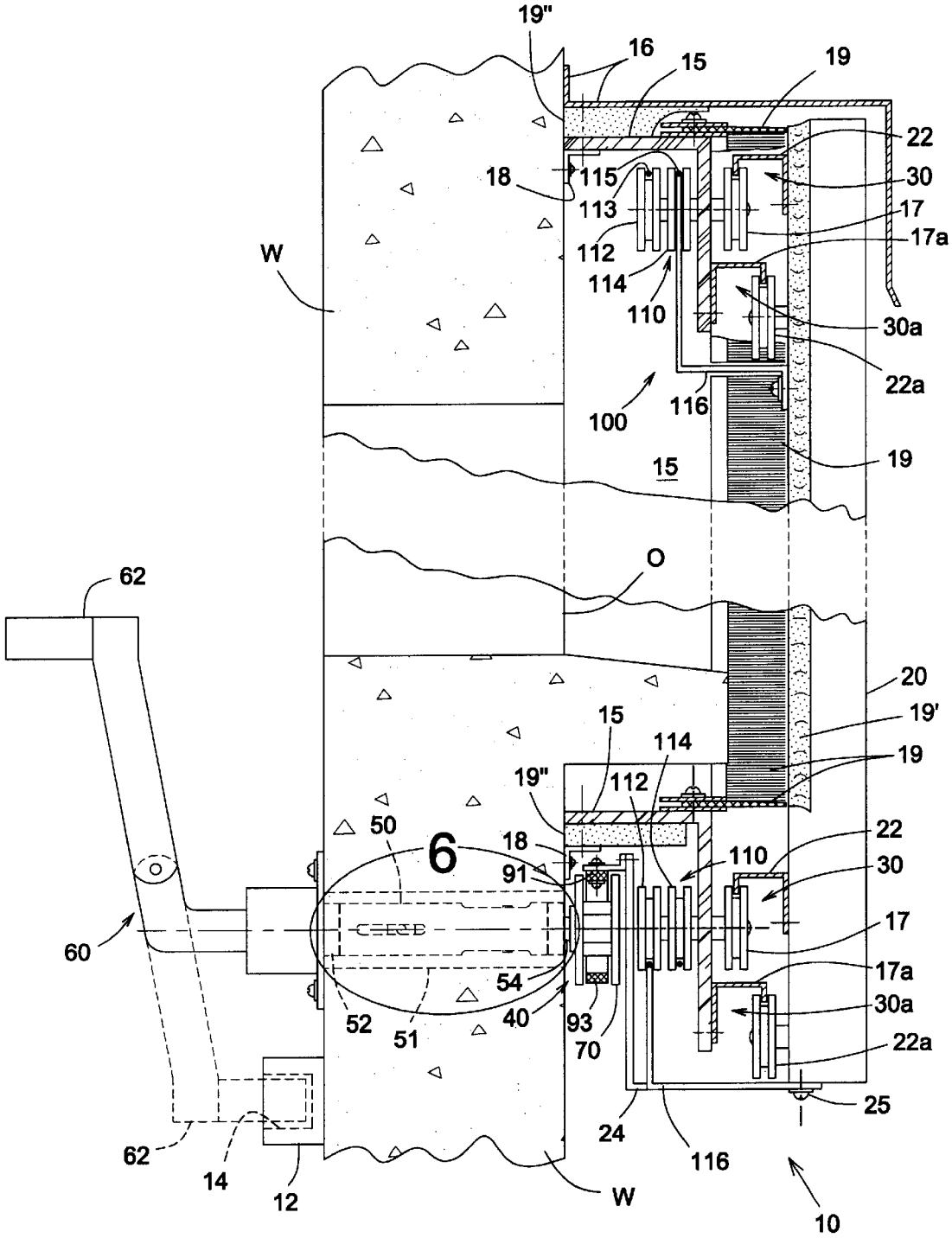
FIG. 3 is a section view taken from the line 3—3 of FIG. 2 showing a universal joint located in a bore of a wall.

Referring to FIGS. 1 and 3, there is shown an external building wall W (for instance with a brick finish) with a window unit inserted within a window opening O and that may be of any standard construction. An embodiment 10 of an external window shutter in accordance with the present invention is installed in front of the window opening O.

The shutter 10 comprises a frame 15 enclosing the window opening O and externally secured to the surface of the wall W. A pair of coplanar panels 20, 20' are movably mounted on the frame 15 via a pair of elongated guide members 30, 30'. Each of the panels 20, 20' are mounted generally parallel to the wall surface and the frame 15. Each of the guide member 30, 30' includes first 17 and second 22 complementary engager parts carried by the frame 15 and a respective one of the panels 20, 20', respectively. The first 17 and second 22 parts slidably engages to each other for lateral or in-plane displacement of the panels 20, 20' relative to the frame 15 between opened (see FIG. 1) and closed (not shown) configurations of the shutter 10. Typically, a pulley 17 mounted on the frame 15 slidably receives a corresponding guide rail 22 mounted on the panel 20. Such a guide 30 is typically mounted to both upper and lower ends of the window facing surface of the panels 20 and the outwardly disposed surface of the frame 15. Moreover, for improved stability of the panels 20, 20' on the frame 15, a reversed guide 30*a*, 30*a'* is also installed for each one of the guides 30, 30'. The reversed guides 30*a* are simply a pulley 22*a* of the panel engaging a corresponding guide rail 17*a* of the frame 15. Obviously, different types of guides 30, 30', 30*a,*

Figure 3A:
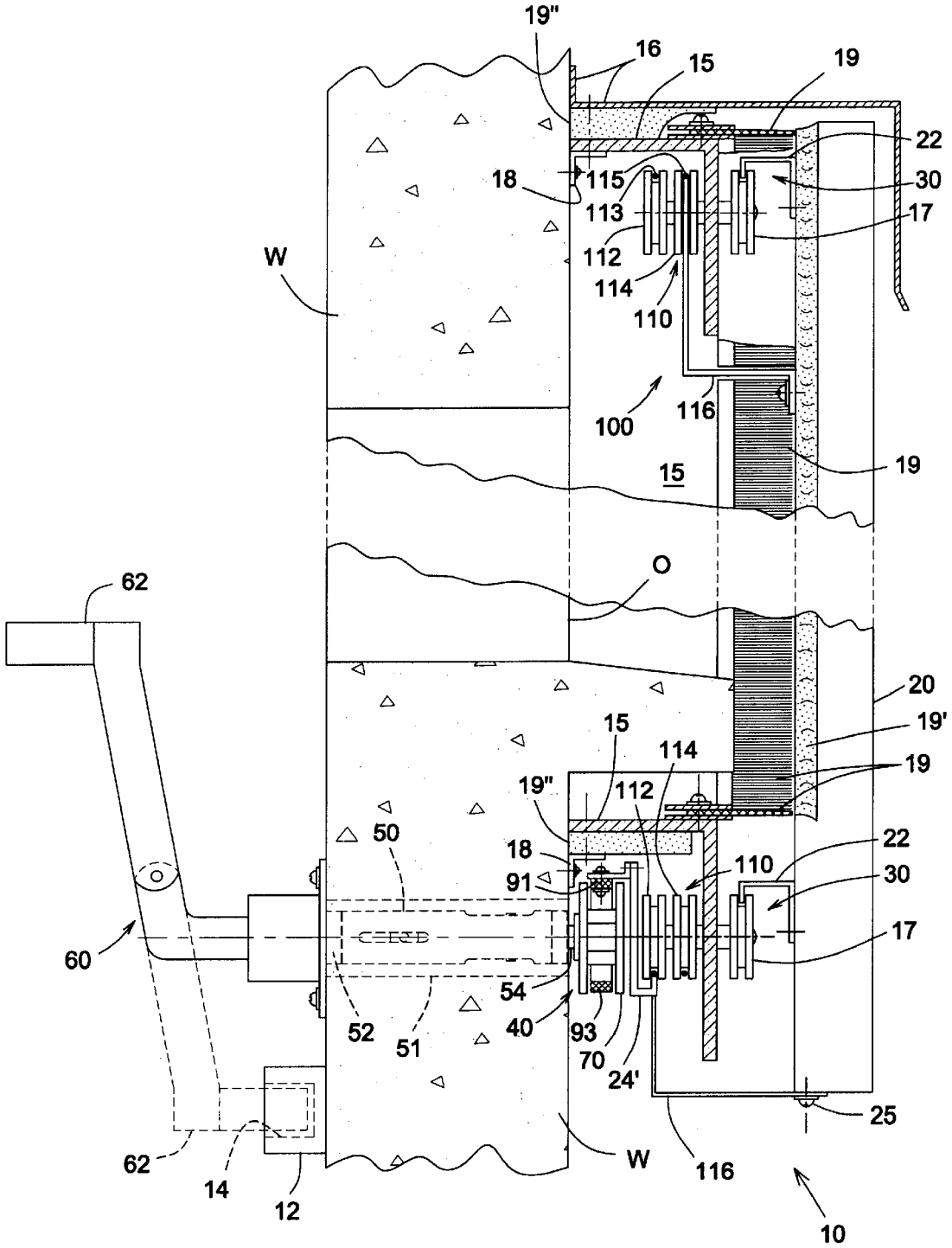
FIG. 3*a* is a section view taken along the line 3*a*—3*a* of FIG. 2*a;*
Figure 5:
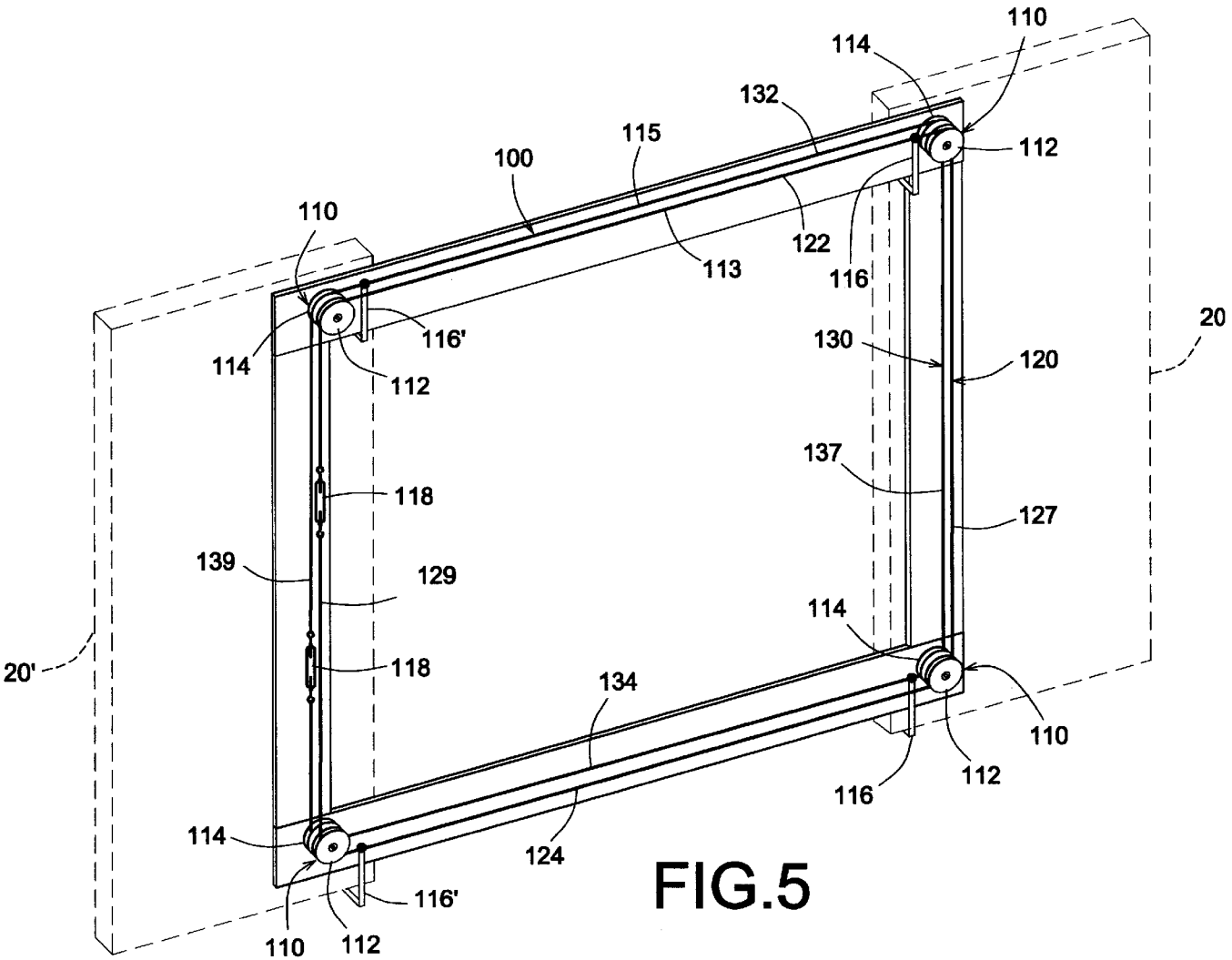
FIG. 5 is a partial view similar to FIG. 2, showing the connection of the panels to the cables of the retaining mechanism.

30*a*' using roller bearings and the like could be considered, especially for the one adjacent the top end of the panels 20, 20'. Alternatively, as illustrated in FIG. 3*a*, the guide rails 17*a* and 30*a* may be removed to allow the bracket 24 to directly engage the transmission belt 90 (described below).

The pair of panels 20, 20' (see FIGS. 1, 2, and 2*a*) are simultaneously displaced in opposite directions along the guides 30, either toward or away from each other (indicated by arrow A) into the closed or opened configuration of the shutter 10, respectively, by a driving mechanism 40 (see FIGS. 2 to 4) carried by the frame 15 and connected to panels 20, 20'. One skilled in the art will recognize that the driving mechanism 40 may be located on any part of the frame 15 depending upon requirements of the user and of the space available on the interior of the building, i.e. above, below or on either side of the window opening O.

The driving mechanism 40 includes a transmission shaft 50 extending through the wall W. The shaft 50 has first 52 and second 54 ends internally and externally protruding from the building wall W, respectively.

A power device, typically a manual crank 60, is connected to the first end 52 of the shaft 50 to rotate the same 50.

A first driving wheel 70 is connected to the second end 54 of the shaft 50 and a second driven wheel 80 is rotatably mounted on the frame 15. The driving 70 and driven 80 wheels are rotatably interconnected by a transmission wire or belt 90 that engages both of them. This belt 90 forms an elongated closed loop that defines two substantially horizontal and linear portions 91, 93 between the wheels 70, 80.

Figure 4:
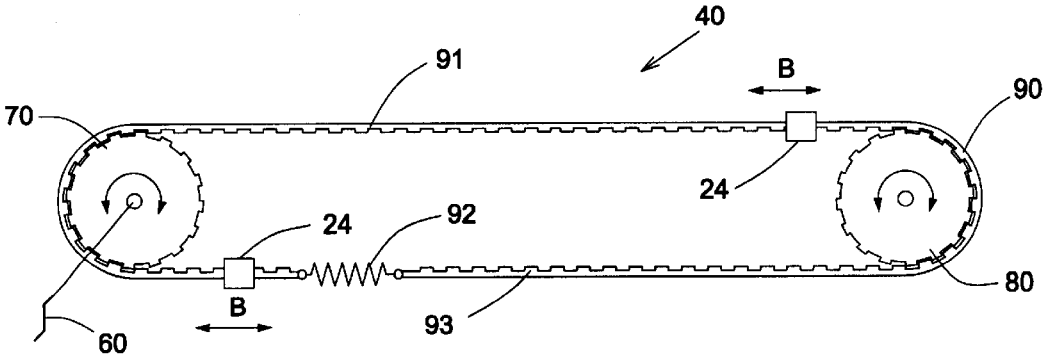
FIG. 4 is an enlarged view taken along line 4 of FIG. 2 with sections taken away.
Figure 2:
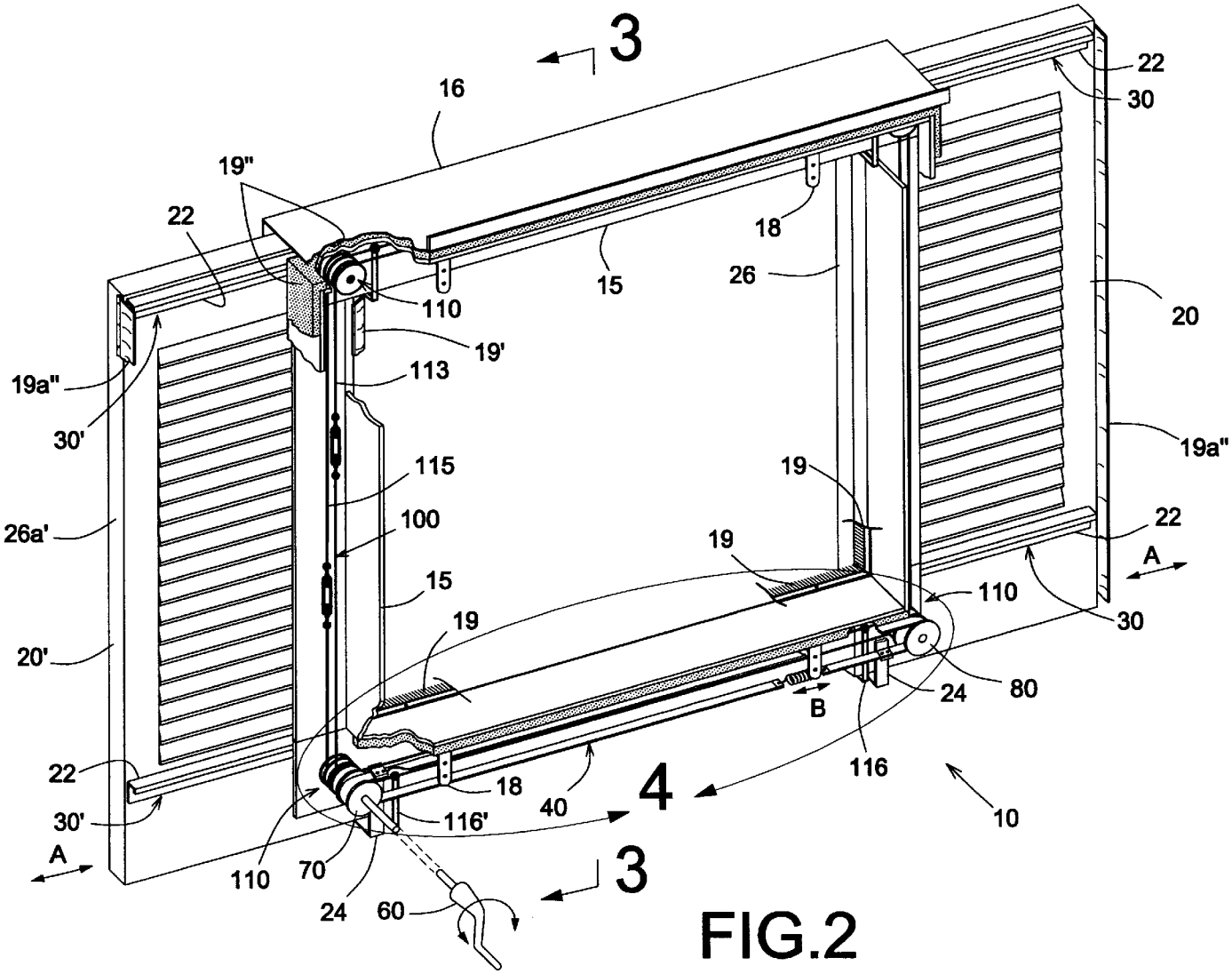
FIG. 2 is a rear perspective view on the external window shutter.

The transmission movement of the portions 91, 93 is illustrated by arrows B of FIGS. 2 and 4. There are two brackets 24, each connecting one of the panels 20, 20' to a respective one of the linear portions 91, 93 of the belt 90. The brackets 24 are mounted on the panels 20, 20' by a screw fastener 25 or the like. Obviously, the length of both linear portions 91, 93 is substantially equal to the travel distance of the panels 20, 20' between the closed and open configurations of the shutter 10 so as to allow their full travel.

The belt 90 includes a tensioning means 92, typically a tension spring (as shown in FIG. 4), longitudinally integrated into at least one of the linear portions 91, 93 in order to ensure a certain tension in the transmission belt 90. As shown in FIG. 4, the transmission belt 90 is a corrugated belt meshing with the two cogwheels 70, 80.

The manually operable crank 60 includes a locking device 12 to prevent activation of the crank 60 and the rotation of the shaft 50 and to lock the panels 20, 20' in place. The locking device 12 is typically a receptacle 14 internally secured to the wall W and adapted to receive a free end 62 of the crank 60 that can pivot therein, as illustrated in dashed lines in FIGS. 3 and 3*a*.

It is therefore easy to unlock and to activate the crank 60 and the driving mechanism 40 from inside the building while impossible to do the same from the outside. Alternatively, the power device 60 could be an electric motor or the like connected either to the first end 52 of the shaft 50 or directly to the driving wheel 70, and located inside or outside the wall W, respectively, with the controls always inside.

The transmission shaft 50 is longitudinally adjustable (see FIGS. 3 and 3*a*) to fit different external walls W i.e. different wall thicknesses. Accordingly, the transmission shaft 50 is adjustably inserted into a tube 51 secured to the building wall W.

Figure 6:
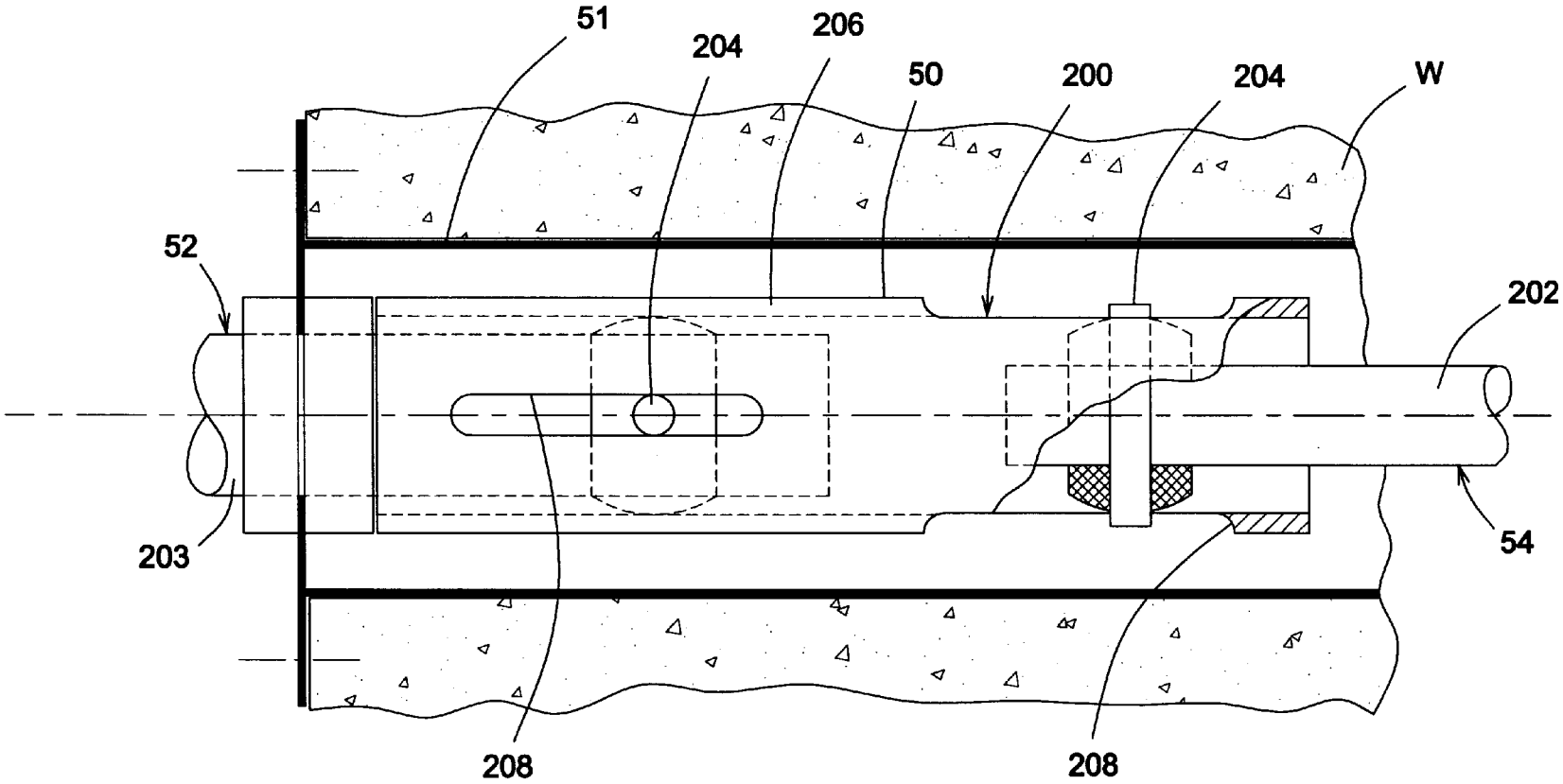
FIG. 6 is an enlarged broken section view taken along line 6—6 of FIG. 3 of the universal joint.

Alternatively, as illustrated in FIG. 6, a universal joint 200 connects together the two ends of the transmission shaft 50. The universal joint 200 includes two shafts 202 and 203 each having a pin 204 extending radially outwardly therefrom. The shafts 202 and 203 are supported and rotatable in a sleeve 206. The sleeve 206 includes a number of elongated slots 208, which in this embodiment are orthogonally disposed, but which may also be axially disposed, into which the pins engage as the crank 60 is rotated. The pins 204 are able to axially slide back and forth in the elongated slots 208. The two shafts 202 and 203 are able to pivot about their respective pins 204 to allow the crank 60 to move laterally relative to the wall.

Referring to FIGS. 2, 2*a*, 3, 3*a* and 5, the shutter 10 includes a retaining mechanism 100 carried by the frame 15 and connected to the panels 20, 20' to constantly retain them in a vertically oriented position, especially when in opened configuration when they protrude laterally out from the frame 15.

The retaining mechanism 100 includes at least four coplanar supports 110 enclosing the window opening O. Each of the supports 110 is mounted on the frame 15 (externally of the same) and includes two coaxial pulleys 112, 114 independently freely rotating from each other. Two cables 113, 115 mesh with a respective one of the two coaxial pulleys 112, 114 of each support 110 to enclose the window opening O to form first 120 and second 130 enclosures that are generally parallel to each other.

Enclosure 120 has upper 122 and lower 124 generally linear horizontal segments interconnected by two generally linear vertical side segments 127, 129, that all extend along the window opening O. Similarly, the enclosure 130 also has upper 132 and lower 134 generally linear horizontal segments interconnected by two generally linear vertical side and segments 137, 139, also all extending along the window opening O.

Figure 2A:
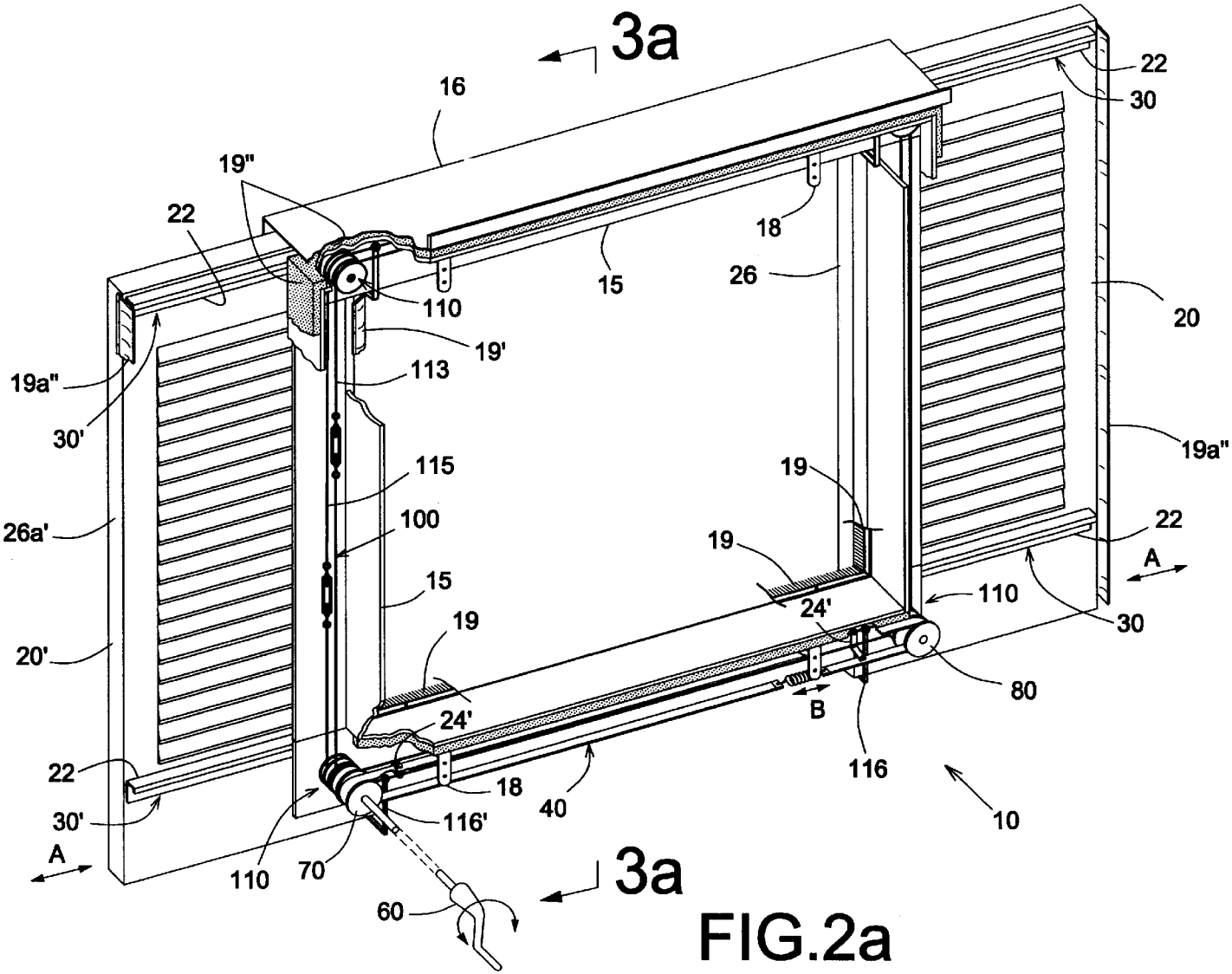
FIG. 2*a* is a partial view similar to FIG. 2, showing the connection of the panels to the cables of the retaining mechanism of a second embodiment.

One 20 of the panels is connected to the upper 122 and to the lower 134 portions of the first 120 and second 130 enclosures, respectively, with the other one 20' of the panels connected to the upper 132 and lower 124 portions of the second 130 and first 120 enclosures, respectively. The panels 20, 20' are connected to the cables 113, 115 in a similar fashion they are connected to the transmission belt 90, using brackets 116, 116', respectively, that are similar to brackets 24. Typically, each one of the cables 113 (or 115) includes a respective tensioning means 118 longitudinally integrated into at least one of the segments 122, 124, 127, 129 (or 132, 134, 137, 139) to ensure a certain tension in the cable 113 (or 115). Alternatively, as illustrated in FIGS. 2*a* and 3*a*, the brackets 24' connected to the transmission belt 90 may directly connect to the cables 113, 115 instead of the panels 20, 20' in order to allow the driving mechanism 40 to be located on any part of the frame 15.

In order to protect most of the parts within the frame 15 of the shutter 10 against wind, snow, rain and ice, shields such as the top one identified by reference 16 in FIGS. 1 to 3*a* are releasably secured either to the external sides of the frame 15 (or eventually to the wall W), all around the frame 15.

Referring to FIGS. 2, 2*a*, 3 and 3*a*, for additional insulation and protection against cold temperatures, the shutter 10 is equipped with flexible sealing devices of any existing type, such as elongated brushes 19, located between the frame 15 and the sliding panels 20, 20', and rigid insulation foam 19" all around the frame 15. The external edges 26*a*, 26*a*' of the panels 20, 20' carry a flexible flap 19*a*", typically made out of rubber type material, incurved inwardly to close off any gap between them and the sides of the frame 15 when in closed configuration. Additionally, a similar flexible sealing device 19' such as a rubber flap is installed on the internal edge 26 of one of the panels 20' and adapted to abut the internal edge 26' of the other panel 20 to seal off the gap between the two when in closed configuration.

The shutter 10 of the present invention can easily be manufactured and pre-assembled prior to installation on the wall W, in front of a window opening O with the insertion of the first end 52 of the transmission shaft 50 into a bore properly made in the wall W. The frame 15 is then simply secured to the wall W, typically using right angle brackets 18 (or bars), and the crank 60 connected to the first end 52 of the shaft 50, inside the building wall W.

The window shutter 10 could also be made out with the panels 20, 20' being of the folding type (not shown).

Because the wall W could have a non-planar slightly curved shape, the shutter 10 could also be non-planar, and have an arc shape or the like to assume the shape of such a window opening (not shown).

For operation of the shutter 10, the user needs only to activate the crank 60 from inside the building to slide the panels 20, 20' in the required position relative to the window opening O.

Although the external window shutter has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. An external window shutter for disposing in front of an exterior window opening, said shutter having a frame surrounding said window opening and attached to an exterior wall surface, said shutter having two panels movably mounted on said frame, said panels being mounted generally parallel to said wall surface and to said frame, said panels being actuatable along a path of travel between an open configuration and a closed configuration, said shutter comprising:

first guide member attached to respective upper and lower portions of a window facing surface of each panel and extending substantially along the entire length of each panel;

second guide member attached to respective upper and lower portions of an outwardly disposed surface of said frame and extending substantially along the entire length of said upper and lower portions of said outwardly disposed surface of said frame;

said first and second guide members each having complementary first and second engager parts shaped to slidably engage each other for moving said panels along said path of travel, said first and second guide members being located on the a same side of said frame;

said panels, when positioned together in said closed configuration, substantially enclose said frame.

2. The shutter of claim 1 further including a driving mechanism carried by said frame and connecting to said panels to simultaneously displace said panels in opposite directions along each of said guide members, either toward or away from each other into said closed or opened configuration of said shutter, respectively, said mechanism including:

a transmission shaft extending through said wall, said shaft having first and second ends internally and externally protruding from said wall, respectively;

a power device connected to said first end of said shaft to rotate said shaft;

a first wheel connected to said second end of said shaft;

a second wheel externally and rotatably mounted on said frame; and a transmission wire engaging said first and second wheels to rotatably connect said second wheel to said first wheel, said wire forming an elongated closed loop defining two substantially linear portions between said first and second wheels, each one of said panels connecting to a respective one of said linear portions of said wire.

3. The shutter of claim 2, wherein said wire including a tensioning means being longitudinally integrated into at least one of said linear portions, thereby ensuring tension in said transmission wire.

4. The shutter of claim 3, wherein said transmission wire being a belt meshing with said wheels.

5. The shutter of claim 4, wherein said wheels being cogwheels and said belt having corrugations meshing with said cogwheels.

6. The shutter of claim 2, wherein said power device being made of a manually operable crank adjustably connected to said first end of said transmission shaft.

7. The shutter of claim 6, wherein said driving mechanism including a locking device preventing rotation of said transmission shaft, thereby blocking said transmission wire and said panels from moving relative to said frame.

8. The shutter of claim 2, wherein said transmission shaft being longitudinally adjustable for fitting different thickness of walls.

9. The shutter of claim 2, wherein said transmission shaft includes a universal joint connecting said first and second ends together, said universal joint being located internally said wall to allow said power device to move laterally relative to said wall.

10. The shutter of claim 1, further including a retaining mechanism carried by said frame and connecting to said panels to constantly retain said panels in a vertically oriented position.

11. The shutter of claim 10, wherein said retaining mechanism including at least four coplanar supports enclosing said window opening, each of said supports mounting on said frame and including two coaxial pulleys independently freely rotating from each other and two cables meshing with a respective one of said two coaxial pulleys of each support to form first and second enclosures around said window opening, each of said enclosures being generally parallel to each other and defining upper and lower generally linear horizontal segments and two generally linear vertical side segments, one of said panels connecting to said upper and lower portions of said first and second enclosures, respectively, with the other one of said panels connecting to said upper and lower portions of said second and first enclosures, respectively.

12. The shutter of claim 11, wherein each one of said cables including a tensioning means being longitudinally integrated into at least one of said segments, thereby ensuring tension in said cables.

13. The shutter of claim 11, further including a driving mechanism carried by said frame and connecting indirectly to said panels through said cables to simultaneously displace said panels in opposite directions along each of said guide members, either toward or away from each other into said closed or opened configuration of said shutter, respectively.

14. The shutter of claim 13, wherein said driving mechanism includes:

a transmission shaft extending through said wall, said shaft having first and second ends internally and externally protruding from said wall, respectively;

a power device connected to said first end of said shaft to rotate said shaft;

a first wheel connected to said second end of said shaft;

a second wheel externally and rotatably mounted on said frame; and a transmission wire engaging said first and second wheels to rotatably connect said second wheel to said first wheel, said wire forming an elongated closed loop defining two substantially linear portions between said first and second wheels, each one of said linear portions of said wire connecting to one of said segments of a respective one of said cables.

15. An external window shutter for installation in front of a window opening of an external wall of a building, said shutter comprising:

a frame enclosing said window opening and externally secured to said wall;

a pair of coplanar panels mounting on said frame and defining a plane;

first and second guide members attached to said panels and said frame, respectively, each of said first and second guide members having complementary first and second engager parts shaped to slidably engage each other for moving said panels along a path of travel, said first and second guide members being located on the a same side of said frame;

said panels, when positioned together in a closed configuration, substantially enclose said frame; and a retaining mechanism carried by said frame and connecting to said panels to constantly retain said panels in a vertically oriented position, said retaining mechanism including:

at least four coplanar supports positioned for enclosing said window opening, each of said supports mounting on said frame and including two coaxial pulleys independently freely rotating from each other and two cables meshing with a respective one of said two coaxial pulleys of each support to form first and second enclosures around said window opening, each of said enclosures being generally parallel to each other and defining upper and lower generally linear horizontal segments and two generally linear vertical side segments, one of said panels connecting to said upper and lower portions of said first and second enclosures, respectively, with the other one of said panels connecting to said upper and rower portions of said second and first enclosures, respectively.

16. The shutter of claim 15, wherein each one of said cables including a tensioning means being longitudinally integrated into at least one of said segments, thereby ensuring tension in said cables.

* * * * *